US006898952B1

(12) United States Patent
Lin

(10) Patent No.: US 6,898,952 B1
(45) Date of Patent: May 31, 2005

(54) ELECTRIC PADLOCK

(75) Inventor: Lung-Yin Lin, Nan-Tou (TW)

(73) Assignee: EZ Trend Technology Co., Ltd., Chia-Yi (TW)

( * ) Notice: Subject to any disclaimer, the term of this patent is extended or adjusted under 35 U.S.C. 154(b) by 0 days.

(21) Appl. No.: 10/836,086

(22) Filed: Apr. 30, 2004

(51) Int. Cl.[7] ..... E05B 67/22

(52) U.S. Cl. ..... 70/38 B; 70/38 A; 70/52; 70/280; 70/282

(58) Field of Search ..... 70/51, 52, 63, 70/38 A, 38 B, 257, 280–282, 277

(56) References Cited

U.S. PATENT DOCUMENTS 3,835,675 A * 9/1974 Lippisch ..... 70/38 A
4,556,872 A * 12/1985 Masoncup et al. ..... 340/542
4,609,780 A * 9/1986 Clark ..... 379/102.06
4,838,052 A * 6/1989 Williams et al. ..... 70/63
4,929,880 A * 5/1990 Henderson et al. ..... 320/134
5,280,518 A * 1/1994 Danler et al. ..... 379/102.06
5,561,996 A * 10/1996 Chang ..... 70/247
6,047,575 A * 4/2000 Larson et al. ..... 70/278.1
6,401,501 B1 * 6/2002 Kajuch et al. ..... 70/25
6,761,051 B1 * 7/2004 Tsai ..... 70/38 B
6,792,779 B1 * 9/2004 Shen ..... 70/38 B

* cited by examiner

*Primary Examiner*—Lloyd A. Gall
(74) *Attorney, Agent, or Firm*—Frommer Lawrence & Haug, LLP; Ronald R. Santucci

(57) ABSTRACT

An electric padlock includes a lock casing, a shackle member, a latch member, and a battery cap member. The lock casing is formed with a battery compartment to receive a battery unit, and a battery access hole. The shackle member extends movably into the lock casing, and is formed with a shackle groove. The latch member is received in the lock casing, and is movable to engage the shackle groove so as to lock the shackle member on the lock casing, and to disengage from the shackle groove so as to unlock the shackle member from the lock casing. The battery cap member is mounted movably on the lock casing to close the battery access hole, and is formed with a stop projection that engages the shackle member so as to inhibit opening movement of the battery cap member when the shackle member is locked on the lock casing.

13 Claims, 4 Drawing Sheets

ELECTRIC PADLOCK

BACKGROUND OF THE INVENTION

1. Field of the Invention

The present invention relates to an electric padlock, more particularly to an electric padlock that can prevent theft of a battery unit therein.

2. Description of the Related Art

A conventional electric padlock includes a lock casing formed with two shackle insert holes. A shackle member has a longer leg portion that is movably disposed in one of the shackle insert holes and that is biased upwardly. A latch member is received in the lock casing, and is movable between locking and unlocking positions for engaging and disengaging a shackle groove in a shorter leg portion of the shackle member. The electric padlock further includes an electric operating unit that has a drive motor mounted in the lock casing, coupled to the latch member, and operable for moving the latch member between the locking and unlocking positions.

The electric operating unit draws electric power from a battery unit that is received in a battery compartment of the lock casing. The lock casing is formed with a battery access hole so that the battery unit can be inserted into and removed from the battery compartment. A battery cap member is mounted removably on the lock casing for closing selectively the battery compartment.

The conventional electric padlock is disadvantageous in that, since the battery cap member can be removed regardless of whether the shackle member is locked or unlocked from the lock casing, the electric padlock can be vandalized by simply removing the battery unit from the battery compartment while the shackle member is locked on the lock casing. Without the battery unit, it is not possible to operate the electric operating unit for unlocking the shackle member from the lock casing.

SUMMARY OF THE INVENTION

Therefore, the object of the present invention is to provide an electric padlock that can overcome the aforesaid drawback associated with the prior art.

Accordingly, an electric padlock of the present invention comprises a lock casing, an inverted U-shaped shackle member, a latch member, and a battery cap member. The lock casing has an end wall formed with first and second shackle insert holes, a battery compartment that is adapted for receiving a battery unit, and a battery access hole that permits insertion of the battery unit into and removal of the battery unit from the battery compartment. The shackle member has first and second leg portions that are extended movably into the lock casing at the first and second shackle insert holes, respectively. One of the first and second leg portions is formed with a shackle groove. The latch member is received in the lock casing, and is movable between a locking position in which the latch member engages the shackle groove so as to lock the shackle member on the lock casing, and an unlocking position in which the latch member is disengaged from the shackle groove so as to unlock the shackle member from the lock casing. The battery cap member is mounted movably on the lock casing for closing selectively the battery access hole, and is formed with a stop projection that engages one of the first and second leg portions so as to inhibit opening movement of the battery cap member when the shackle member is locked on the lock casing, and that is disengaged from said one of the first and second leg portions so as to permit opening movement of the battery cap member when the shackle member is unlocked from the lock casing.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
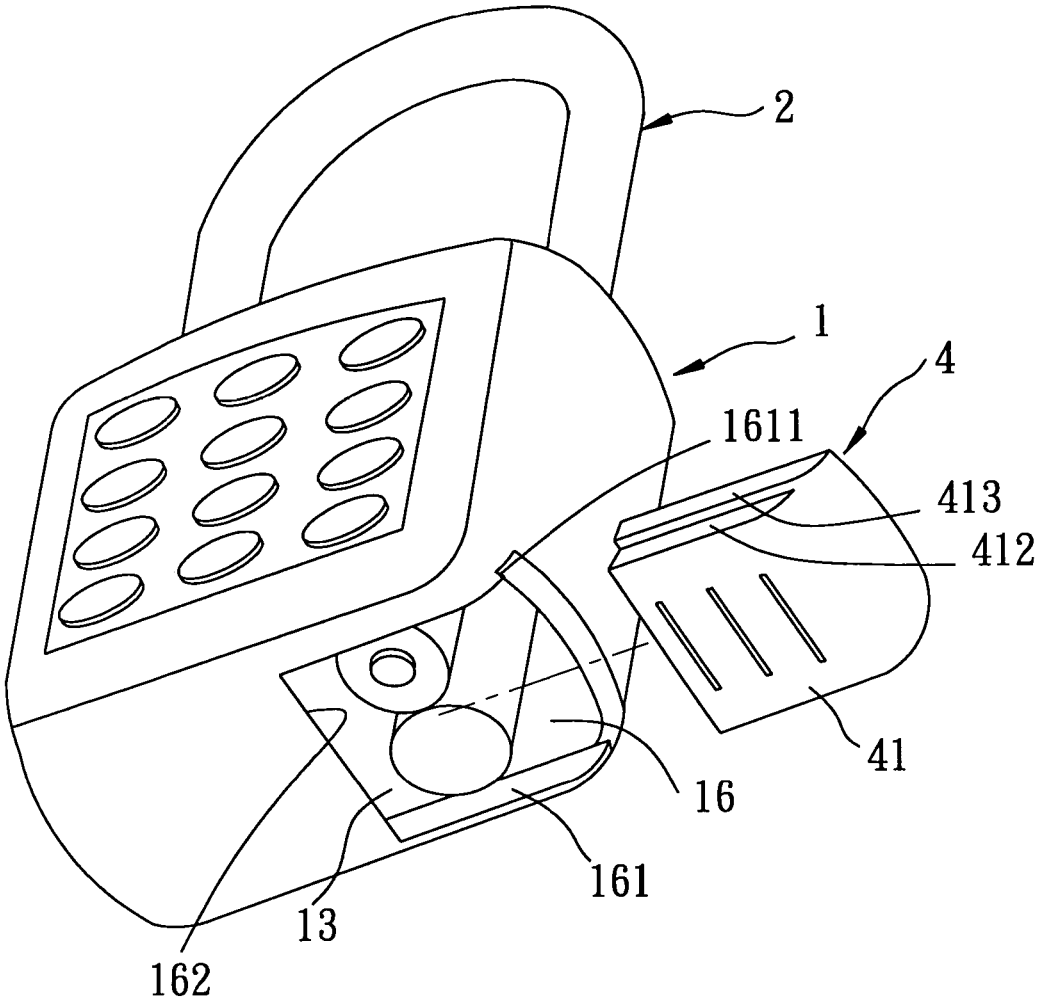
FIG. 1 is a perspective view illustrating the preferred embodiment of an electric padlock according to the present invention.
Figure 2:
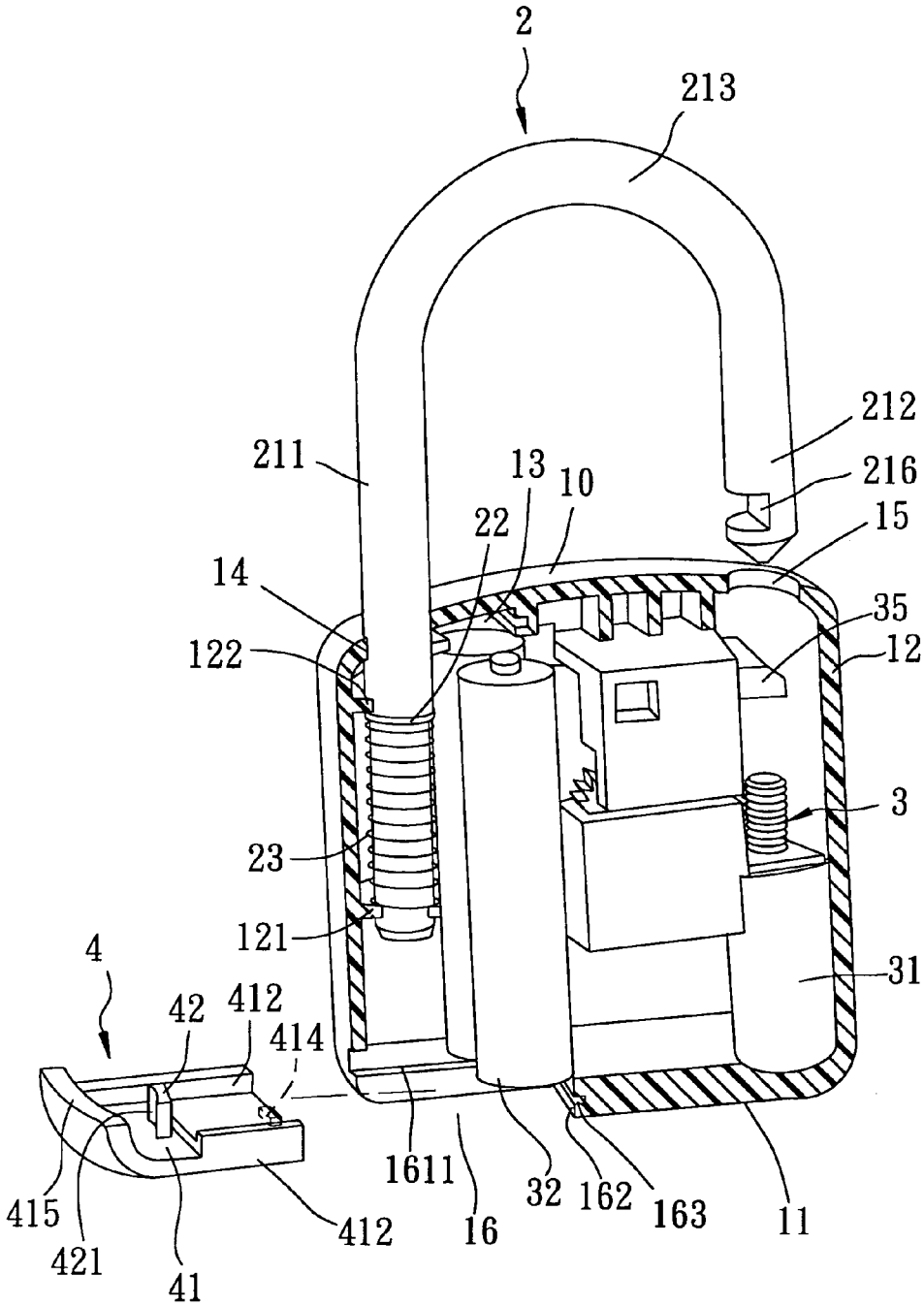
FIG. 2 is a partly cutaway perspective view of the preferred embodiment.

Referring to FIGS. 1 and 2, the preferred embodiment of an electric padlock according to the present invention is shown to include a lock casing 1, an inverted U-shaped shackle member 2, a latch member 35, and a battery cap member 4.

The lock casing 1 has a first end wall 10, a second end wall 11 opposite to the first end wall 10, and a surrounding wall 12 that extends between and that interconnects the first and second end walls 10, 11. The first end wall 10 is formed with first and second shackle insert holes 14, 15. The lock casing 1 further has a battery compartment 13 that is adapted for receiving a battery unit 32, and a battery access hole 16 that permits insertion of the battery unit 32 into and removal of the battery unit 32 from the battery compartment 13. The battery access hole 16 is formed in the second end wall 11, extends to the surrounding wall 12, and is defined by a pair of lateral wall portions 161 and a distal wall portion 162 that interconnects the lateral wall portions 161. One of the lateral wall portions 161 is formed with a slide groove 1611. The distal wall portion 162 is formed with a tongue engaging groove 163. In this embodiment, the battery compartment 13 is disposed adjacent to the first shackle insert hole 14, and the battery access hole 16 is registered with the battery compartment 13 and the first shackle insert hole 14. The lock casing 1 is further formed with a spring seat 121 and a limit flange 122 that are registered with the first shackle insert hole 14. The limit flange 122 is disposed above the spring seat 121.

The shackle member 2 has first and second leg portions 211, 212 that are extended movably into the lock casing 1 at the first and second shackle insert holes 14, 15, respectively, and a curved connecting portion 213 that interconnects upper ends of the first and second leg portions 211, 212. The first leg portion 211 is longer than the second leg portion 212, and has a retaining ring 22 provided thereon. The retaining ring 22 abuts against the limit flange 122 to prevent removal of the shackle member 2 from the lock casing 1. A biasing member 23, in the form of a coil spring, is disposed in the lock casing 1 and is sleeved on the first leg portion 211. The biasing member 23 has a lower end seated on the spring seat 121, and an upper end abutting against the retaining ring 22. The biasing member 23 thus acts on the first leg portion 211 for biasing the first leg portion 211 toward the first end wall 10 of the lock casing 1. The second leg portion 212 is formed with a shackle groove 216.

The latch member 35 is a spring-loaded member having a latching portion 351 and an actuated portion 352 connected to the latching portion 351. The latch member 35 is received in the lock casing 1, and is movable in the lock casing 1 between a locking position (see FIG. 4) in which the latching portion 351 engages the shackle groove 216 in the second leg portion 212 so as to lock the shackle member 2 on the lock casing 1, and an unlocking position (see FIG. 3) in which the latching portion 351 is disengaged from the shackle groove 216 so as to unlock the shackle member 2 from the lock casing 1.

Figure 3:
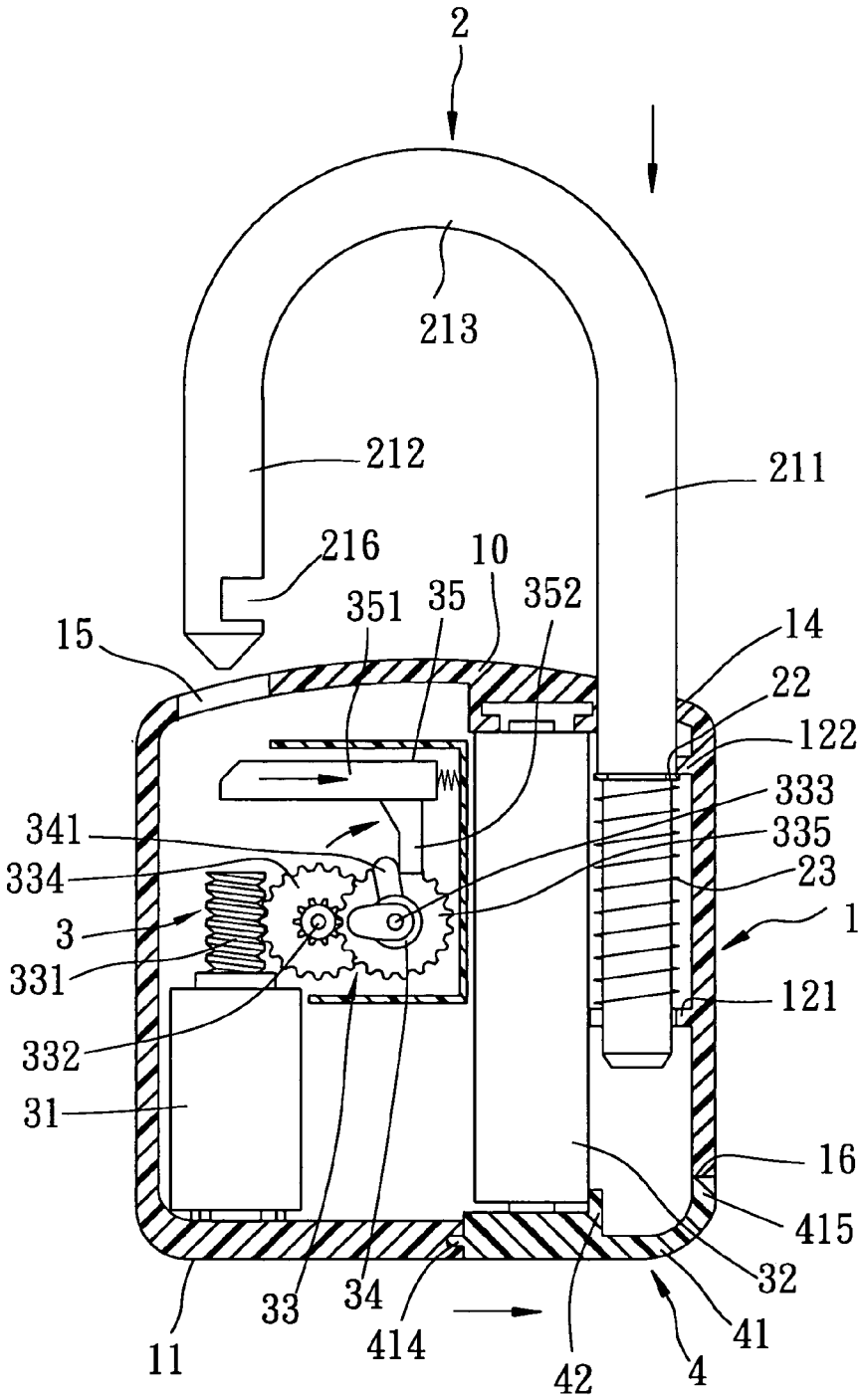
FIG. 3 is a partly sectional view to illustrate an unlocked state of the preferred embodiment.

The battery cap member 4 is mounted slidably and removably on the second end wall 11 of the lock casing 1 for closing selectively the battery access hole 16, and is formed with a stop projection 42 that engages the first leg portion 211 so as to inhibit opening movement of the battery cap member 4 when the shackle member 2 is locked on the lock casing 1 (see FIG. 4), and that is disengaged from the first leg portion 211 so as to permit opening movement of the battery cap member 4 when the shackle member 2 is unlocked from the lock casing 1 (see FIG. 3). The first leg portion 211 is disposed on one side of the stop projection 42 opposite to the distal wall portion 162 when the battery cap member 4 is disposed to close the battery access hole 16 and when the shackle member 2 is locked on the lock casing 1. In this embodiment, the stop projection 42 is configured with a curved face 421 for embracing a part of the first leg portion 211 when the battery cap member 4 is disposed to close the battery access hole 16 and when the shackle member 2 is locked on the lock casing 1. The battery cap member 4 includes a cap body 41 formed with the stop projection 42 and having a pair of lateral sides 412 slidably retained by the lateral wall portions 161 of the battery access hole 16. In this embodiment, one of the lateral sides 412 of the cap body 41 is formed with a slide projection 413 that is slidable along the slide groove 1611. The cap body 41 is further formed with a tongue projection 414 that engages the tongue engaging groove 163 when the battery cap member 4 is disposed to close the battery access hole 16, as best shown in FIG. 3. In addition, the cap body 41 further has a curved wall portion 415 that is opposite to the distal wall portion 162 and that is flush with the surrounding wall 12 when the battery cap member 4 is disposed to close the battery access hole 16, as best shown in FIG. 3.

The electric padlock of this embodiment further includes an electric operating unit 3 mounted in the lock casing 1, coupled to the latch member 35, and adapted to draw electric power from the battery unit 32 in the battery compartment 13. The electric operating unit 3 is operable so as to drive movement of the latch member 35 from the locking position to the unlocking position. In this embodiment, the electric operating unit 3 is disposed in the lock casing 1 such that the battery compartment 13 is disposed between the first shackle insert hole 14 and the electric operating unit 3, and includes a drive motor 31, a gear unit 33 coupled to and driven by the drive motor 31, and a latch actuator 34 coupled to the gear unit 33 and driving movement of the latch member 35 from the locking position to the unlocking position. The drive motor 31 is aligned with the second shackle insert hole 15. The gear unit 33 includes a worm gear 331 provided on a drive shaft of the drive motor 31, a first gear 334 mounted rotatably in the lock casing 1 via a first gear axle 332 and meshing with the worm gear 331, and a second gear 335 mounted rotatably in the lock casing 1 via a second gear axle 333 and meshing with the first gear 334. The latch actuator 34 is driven by the second gear 335, and has an actuating portion 341 that engages the actuated portion 352 of the latch member 35. Therefore, when the electric operating unit 3 is activated, such as by remote control or by manual input of a code through a keypad on the lock casing 1, the drive motor 31 drives rotation of the gear unit 33, which results in corresponding movement of the latch actuator 34 for driving the latch member 35 to move from the locking position to the unlocking position.

It should be noted herein that the electric operating unit 3 exemplified in this embodiment is solely for illustrative purposes. The electric operating unit 3 may be replaced using other known mechanisms, such as a key-operated mechanism, for driving movement of the latch member 35. Since the main feature of this invention does not reside in the configurations of alternative implementations of the electric operating unit 3, which are known in the art, they will not be described herein for the sake of brevity.

As shown in FIG. 3, when the shackle member 2 is unlocked from the lock casing 1, the first leg portion 211 does not hinder removal of the battery cap member 4 from the lock casing 1 such that the battery unit 32 can be inserted into and removed from the battery compartment 13 at this time.

Figure 4:
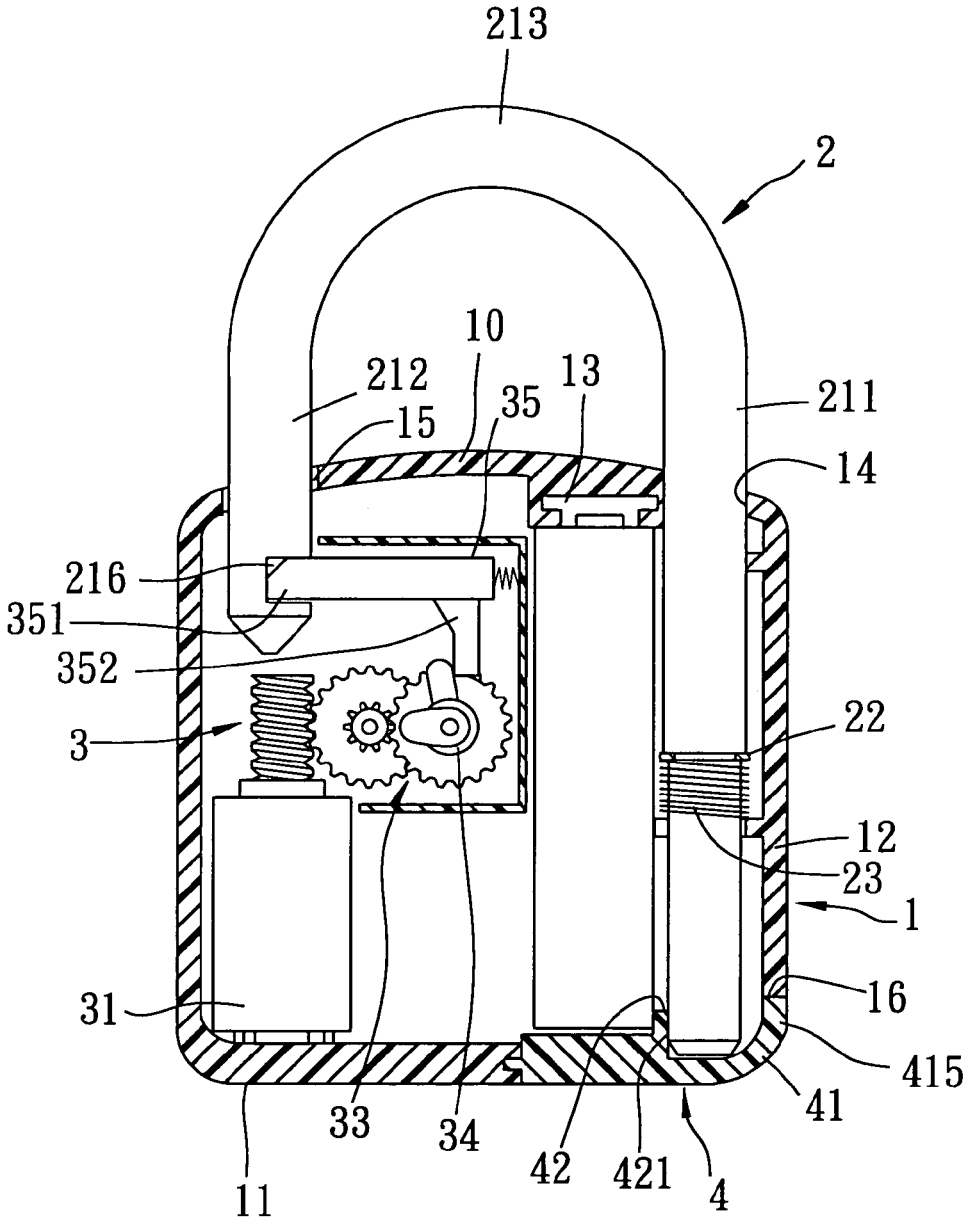
FIG. 4 is a partly sectional view to illustrate a locked state of the preferred embodiment.

Referring to FIG. 4, when the shackle member 2 is locked on the lock casing 1, the stop projection 42 on the battery cap member 4 engages the first leg portion 211 so as to inhibit opening movement of the battery cap member 4, thereby preventing theft of the battery unit 32 when the shackle member 2 is locked on the lock casing 1.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. An electric padlock comprising:

a lock casing having a first end wall formed with first and second shackle insert holes, a battery compartment that is adapted for receiving a battery unit, and a battery access hole that permits insertion of the battery unit into and removal of the battery unit from said battery compartment;

an inverted U-shaped shackle member having first and second leg portions that are extended movably into said lock casing at said first and second shackle insert holes, respectively, one of said first and second leg portions being formed with a shackle groove;

a latch member received in said lock casing and movable between a locking position in which said latch member engages said shackle groove so as to lock said shackle member on said lock casing, and an unlocking position in which said latch member is disengaged from said shackle groove so as to unlock said shackle member from said lock casing; and a battery cap member mounted movably on said lock casing for closing selectively said battery access hole, said battery cap member being formed with a stop projection that engages one of said first and second leg portions so as to inhibit opening movement of said battery cap member when said shackle member is locked on said lock casing, and that is disengaged from said one of said first and second leg portions so as to permit opening movement of said battery cap member when said shackle member is unlocked from said lock casing, wherein said lock casing further has a second end wall opposite to said first end wall, and a surrounding wall that extends between and that interconnects said first and second end walls, said battery access hole being formed in said second end wall and extending to said surrounding wall, said battery cap member being mounted slidably on said second end wall of said lock casing.

2. The electric padlock as claimed in claim 1, wherein said battery access hole is defined by a pair of lateral wall portions and a distal wall portion that interconnects said lateral wall portions, said battery cap member having a pair of lateral sides slidably retained by said lateral wall portions of said battery access hole.

3. The electric padlock as claimed in claim 2, wherein one of said lateral wall portions is formed with a slide groove, and one of said lateral sides of said battery cap member is formed with a slide projection that is slidable along said slide groove.

4. The electric padlock as claimed in claim 2, wherein said distal wall portion is formed with a tongue engaging groove, said battery cap member being formed with a tongue projection that engages said tongue engaging groove when said battery cap member is disposed to close said battery access hole.

5. The electric padlock as claimed in claim 2, wherein said battery cap member further has a curved wall portion that is opposite to said distal wall portion and that is flush with said surrounding wall when said battery cap member is disposed to close said battery access hole.

6. The electric padlock as claimed in claim 2, wherein said first leg portion is longer than said second leg portion, said battery compartment being disposed adjacent to said first shackle insert hole, said battery access hole being registered with said battery compartment and said first shackle insert hole.

7. The electric padlock as claimed in claim 6, wherein said first leg portion is disposed on one side of said stop projection opposite to said distal wall portion when said battery cap member is disposed to close said battery access hole and when said shackle member is locked on said lock casing.

8. The electric padlock as claimed in claim 7, wherein said stop projection is configured to embrace a part of said first leg portion when said battery cap member is disposed to close said battery access hole and when said shackle member is locked on said lock casing.

9. The electric padlock as claimed in claim 6, wherein said shackle groove is formed in said second leg portion.

10. The electric padlock as claimed in claim 6, further comprising a biasing member disposed in said lock casing and acting on said first leg portion for biasing said first leg portion toward said first end wall.

11. The electric padlock as claimed in claim 1, further comprising an electric operating unit mounted in said lock casing, coupled to said latch member, and adapted to draw electric power from the battery unit in said battery compartment, said electric operating unit being operable so as to drive movement of said latch member from said locking position to said unlocking position.

12. The electric padlock as claimed in claim 11, wherein said electric operating unit includes a drive motor, a gear unit coupled to and driven by said drive motor, and a latch actuator coupled to said gear unit and driving movement of said latch member from said locking position to said unlocking position.

13. The electric padlock as claimed in claim 12, wherein said battery compartment is disposed between said first shackle insert hole and said electric operating unit.

* * * * *